US007288000B2

(12) United States Patent
Liu et al.

(10) Patent No.: US 7,288,000 B2
(45) Date of Patent: Oct. 30, 2007

(54) BUFFER STRUCTURE FOR POWER CORD CONNECTOR

(75) Inventors: Chia-Fu Liu, Taoyuan Hsien (TW); Hun-Chieh Hsu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/335,777

(22) Filed: Jan. 19, 2006

(65) Prior Publication Data

US 2007/0020989 A1 Jan. 25, 2007

(30) Foreign Application Priority Data

Jul. 21, 2005 (TW) ..... 94124778 A

(51) Int. Cl.
*H01R 13/56* (2006.01)

(52) U.S. Cl. ..... 439/447

(58) Field of Classification Search ..... 439/447, 439/445, 446, 448; 174/135
See application file for complete search history.

(56) References Cited

U.S. PATENT DOCUMENTS 3,800,068 A * 3/1974 Torgerson ..... 174/135
4,990,103 A * 2/1991 Sazaki et al. ..... 439/455
5,100,341 A * 3/1992 Czyz et al. ..... 439/447
5,340,330 A * 8/1994 Dolson et al. ..... 439/447
5,620,335 A * 4/1997 Siemon ..... 439/491
6,068,506 A * 5/2000 Shen ..... 439/447
6,139,354 A * 10/2000 Broussard ..... 439/447
6,155,866 A * 12/2000 Liu et al. ..... 439/447
6,220,888 B1 * 4/2001 Correa ..... 439/445
6,322,386 B1 * 11/2001 Tharp et al. ..... 439/344
6,416,351 B1 * 7/2002 Ho ..... 439/447
6,733,322 B2 * 5/2004 Boemmel et al. ..... 439/445
6,827,601 B1 * 12/2004 Haeberle ..... 439/447

* cited by examiner

*Primary Examiner*—Gary F. Paumen

(57) ABSTRACT

A buffer structure for a power cord connector is disclosed. The buffer structure comprises a main body, a plurality of slits and a coating layer. The main body covers on an exterior of a power cord at a connecting end to an electronic apparatus. The plurality of slits are disposed on the main body, wherein a top area is larger than a bottom area of each of the slits. The coating layer is disposed at bottoms of the slits, wherein a thickness of the coating layer at the slit close to the connecting end is larger than that at the slit away from the connecting end. Both the strength and the flexibility of the buffer structure are enhanced according to the present invention, so as to prevent the buffer structure from breakage due to bending.

19 Claims, 9 Drawing Sheets

BUFFER STRUCTURE FOR POWER CORD CONNECTOR

FIELD OF THE INVENTION

The present invention relates to a buffer structure for a power cord connector, and more particularly to a buffer structure for a power cord connector which can buffer the bending stress to avoid breakage as bending.

BACKGROUND OF THE INVENTION

The adapter is an essential electronic device frequently used in the daily life, and is used to convert the commercial AC power into the DC power for supplying to the power-receiving electronic apparatus, such as notebook or mobile phone.

Please refer to FIG. 1, which is a schematic diagram showing an adapter supplying power to a notebook according to the prior art. As shown in FIG. 1, the adapter 11 has one end connected to the AC power cord 12 and the AC plug 13, and the other end connected to the DC power cord 14 and the connecting terminal 15. When supplying power to the notebook 16, the connecting terminal 15 is plugged into the power-receiving hole 161 of the notebook 16, and the adapter 11 converts the AC power inputted by the AC plug 13 and the AC power cord 12 into the DC power and supplies the DC power to the notebook 16 through the DC power cord 14 and the connecting terminal 15.

Since sometimes the user has to use the electronic apparatus in a limited space, when the connecting terminal of the power cord is plugged on the electronic apparatus, the power cord usually needs to be bent for placing the electronic apparatus in the table corner or wall corner to save the utilization of the space. Therefore, the power cord that is close to the connecting terminal may be broken due to the frequent bending. In addition, when using the electronic apparatus, for example, when charging the mobile phone, an inadvertent touch may cause the mobile phone to fall down from the table; meanwhile, the power cord that is connected to the mobile phone is probable to be broken.

At present, many products having a buffer structure covered on the connecting end of the power cord and the connecting terminal are available in the market. The buffer structure is a plastic mold covering on the exterior of the power cord. However, the designs of those buffer structures mostly focus on the enhancement of the flexibility to facilitate the bending of the power cord, but the strengths thereof are insufficient. When the power cord has been bent many times or has a heavy load, the buffer structure, even the power cord covered therein, may still be broken. Therefore, the present invention provides an improved buffer structure to deal with the defects of the prior art described above.

SUMMARY OF THE INVENTION

An object of the present invention is to provide a buffer structure for a power cord connector, whose strength and flexibility are both increased to effectively protect the connection between the power cord and the connecting terminal from breakage due to bending, so as to ensure the power supply to the electronic apparatus.

According to an aspect of the present invention, the buffer structure for a power cord connector comprises a main body, a plurality of slits and a coating layer. The main body covers on an exterior of a power cord at a connecting end to an electronic apparatus. The plurality of slits are disposed on the main body, wherein a top area is larger than a bottom area of each of the slits. The coating layer is disposed at bottoms of the slits, wherein a thickness of the coating layer at the slit close to the connecting end is larger than that at the slit away from the connecting end.

In an embodiment, the main body is a cylinder with different diameters at upper and lower sides, wherein a cross-section area of the main body close to the connecting end is larger than that of the main body away from the connecting end.

In an embodiment, a width of the slit away from the connecting end is larger than that of the slit close to the connecting end.

In an embodiment, in an axial direction of the power cord, two adjacent slits define a spacer therebetween, and a width of the spacer away from the connecting end is smaller than that of the spacer close to the connecting end.

In an embodiment, corners of each of the slits are round angles.

In an embodiment, the buffer structure further comprises an inner mold disposed in an interior of the main body close to the connecting end and having a larger hardness than other parts of the main body.

According to another aspect of the present invention, the buffer structure for a power cord connector comprises a main body, a plurality of slits and a coating layer. The main body covers on an exterior of a power cord at a connecting end to an electronic apparatus. The plurality of slits are disposed on the main body, wherein a width of the slit away from the connecting end is larger than that of the slit close to the connecting end. The coating layer is disposed at bottoms of the slits, wherein a thickness of the coating layer at the slit close to the connecting end is larger than that at the slit away from the connecting end.

According to an additional aspect of the present invention, the buffer structure for a power cord connector comprises a main body, a plurality of slits and a coating layer. The main body covers on an exterior of a power cord at a connecting end to an electronic apparatus. The plurality of slits are disposed on the main body, wherein in an axial direction of the power cord, two adjacent slits define a spacer therebetween, and a width of the spacer away from the connecting end is smaller than that of the spacer close to the connecting end. The coating layer is disposed at bottoms of the slits, wherein a thickness of the coating layer at the slit close to the connecting end is larger than that at the slit away from the connecting end.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
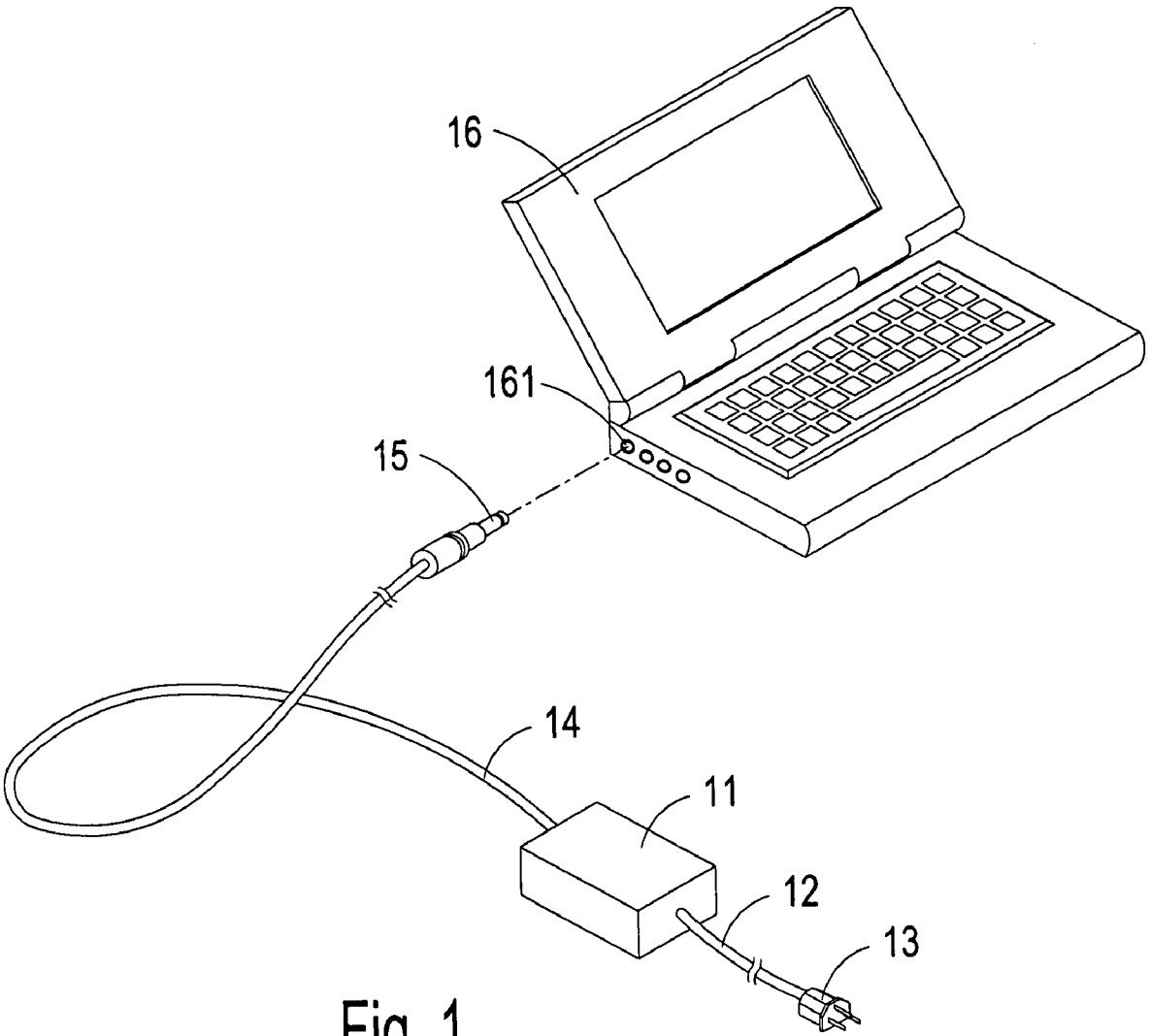
Fig. 1 PRIOR ART
FIG. 1 is a schematic diagram showing an adapter supplying power to a notebook according to the prior art.
Figure 2:
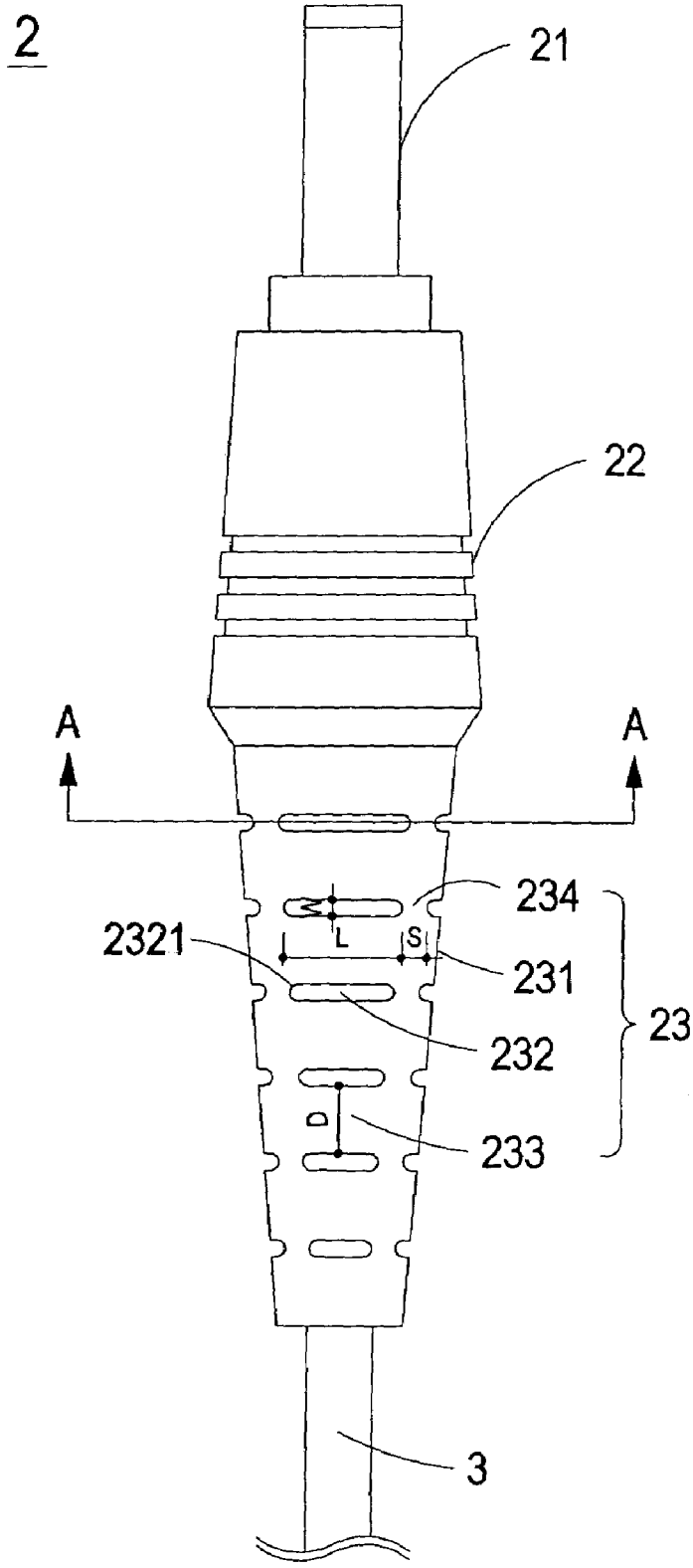
FIG. 2 is a schematic diagram showing the power cord connector according to a preferred embodiment of the present invention.

Please refer to FIG. 2, which is a schematic diagram showing the power cord connector according to a preferred embodiment of the present invention. The power cord connector is used to conduct the DC power, which is converted by an adapter, to a power-receiving electronic apparatus, such as a notebook, through a DC power cord. As shown in FIG. 2, the power cord connector 2 is connected with a power cord 3 and comprises a connecting terminal 21, a holding portion 22 and a buffer structure 23. The connecting terminal 21 is used for plugging into a power-receiving hole of an electronic apparatus. The holding portion 22 covers on the connecting end of the power cord 3 and the connecting terminal 21 to facilitate the user holding the power cord connector 2 and plugging the power cord connector 2 onto the electronic apparatus. The buffer structure 23 comprises a main body 231 extending from the holding portion 22 and covering on the exterior of the power cord 3. The object of the present invention is to enhance the strength of the buffer structure 23 for avoiding the buffer structure 23 or the power cord 3 covered by the buffer structure 23 from breakage due to the bending, and also increase the flexibility of the buffer structure 23 for facilitating the bending of the power cord 3. The feature of the buffer structure 23 of the present invention will be further described as follow.

For the convenience of description, the portion of the buffer structure 23 that is close the connecting terminal 21 is defined as the upper side, and the portion of the buffer structure 23 that is away from the connecting terminal 21 is defined as the lower side. In an embodiment, the appearance of the buffer structure 23 is a cylinder with different diameters at the upper and lower sides. As shown in FIG. 2, the diameter at the upper side of the buffer structure 23 is larger than that at the lower side, i.e. the cross-section area at the upper side of the buffer structure 23 is larger than that at the lower side, but not limited thereto. For example, the buffer structure 23 can also be a cylinder with an even diameter at the upper and lower sides.

The buffer structure 23 comprises a plurality of long and narrow slits 232 disposed on the main body 231 and having a length L and a width W. In the axial direction of the power cord 3, the two adjacent slits 232 define a spacer 233 therebetween, and the spacer 233 has a width D. In the circumference direction of the main body 231, the two adjacent slits 232 define a rib 234 therebetween, and the rib 234 has a width S. As shown in the embodiment of FIG. 2, the plurality of slits 232 are arranged in a plurality of rows, preferably in even rows, wherein the slits 232 in each row are arranged in parallel, and the long edge (L) of each slit 232 is vertical to the axial direction of the power cord 3. Certainly, the arrangement of the slits 232 is not limited to the embodiment described above; for example, the plurality of slits 232 can be arranged in stagger but not regularly arranged in a plurality of rows. Or, each slit 232 can be arranged at a specific angle relative to the axial direction of the power cord 3 to accommodate a specific bending angle.

Figure 3B:
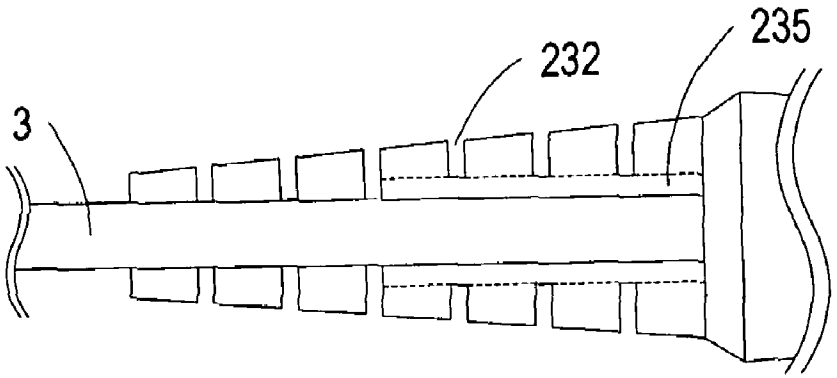
FIGS. 3(*a*) and 3(*b*) show cross-section views of the buffer structure according to preferred embodiments of the present invention.
Figure 3A:
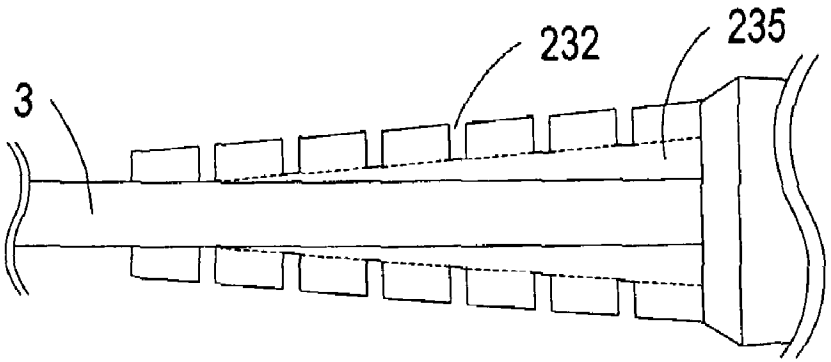

Please refer to FIGS. 3(*a*) and 3(*b*), which show cross-section views of the buffer structure according to preferred embodiments of the present invention. As shown in FIG. 3(*a*), a coating layer 235 is disposed at the bottoms of the slits 232 of the buffer structure 23. In other words, a coating layer 235 is disposed on the exterior of the power cord 3. The coating layer 235 has various thicknesses, wherein the thickness of the coating layer 235 is smaller and smaller from the upper side to the lower side of the buffer structure 23, and the variation of the thickness can be in regular progress, such as in arithmetic progression or geometric progression, or in irregular progress, and the lowest slit 232 may not have the coating layer 235 at the bottom thereof to expose the power cord 3. Since the bending stress is larger at the location close the connecting terminal 231 when the power cord 3 is bent, the buffer structure 23 is designed to have a stronger strength at the location close to the connecting terminal 231 through the coating layer 235 having different thicknesses, so that the buffer structure 23 will not easy to be broken so as to protect the power cord 3 covered therein.

Certainly, the thickness variation of the coating layer 235 may be designed as group change with respect to the slits 232. For example, in the condition that the buffer structure has six slits 232 in each row, the upper three slits 232 have the coating layer 235 with the same thickness, and the lower three slits 232 have no coating layer 235, as shown in FIG. 3(*b*). In this embodiment, the strength of the buffer structure 23 close to the connecting end of the power cord 3 and the connecting terminal 21 can also be enhanced.

Figure 4:
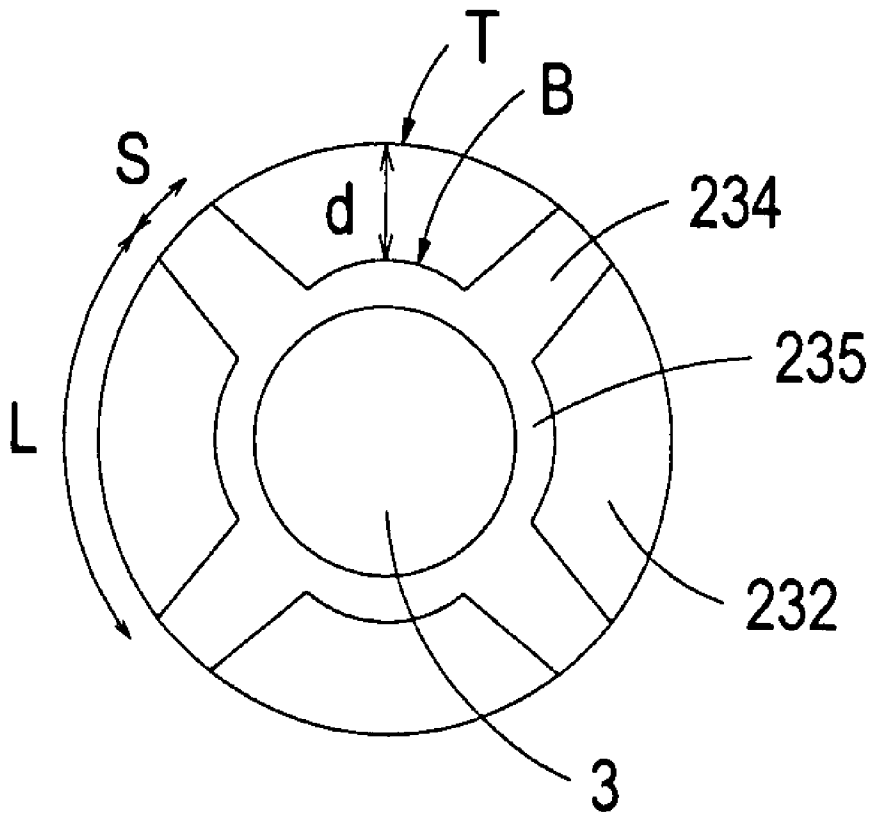
FIG. 4 is a cross-section view of the buffer structure along A-A line in FIG. 2.

Please refer to FIG. 4, which is a cross-section view of the buffer structure along A-A line in FIG. 2. As shown in FIG. 4, the length (L) at the top (T) of the slit 232 is larger than that at the bottom (B). That is to say, in the depth (d) direction of the slit 232, the length of the slit 232 gets decreased gradually from the top to the bottom, and accordingly, the width (S) of the rib 234 gets increased gradually from the top to the bottom. In other words, the top area of the slit 232 is larger than the bottom area of the slit 232. Such design can also enhance the strength of the buffer structure 23 to avoid the breakage of the buffer structure 23 due to the bending stress, and further protect the power cord 3 covered therein.

Figure 5B:
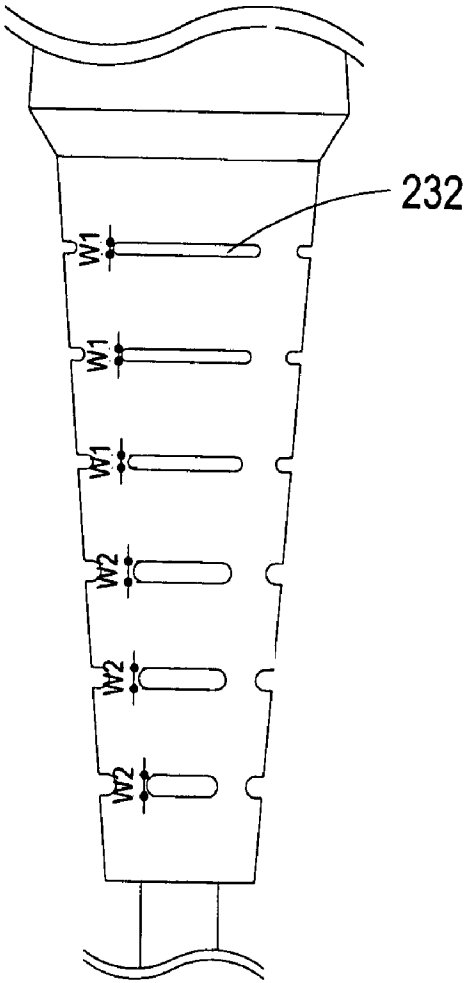
FIGS. 5(*a*) and (*b*) are schematic diagrams showing the buffer structure according to preferred embodiments of the present invention.
Figure 5A:
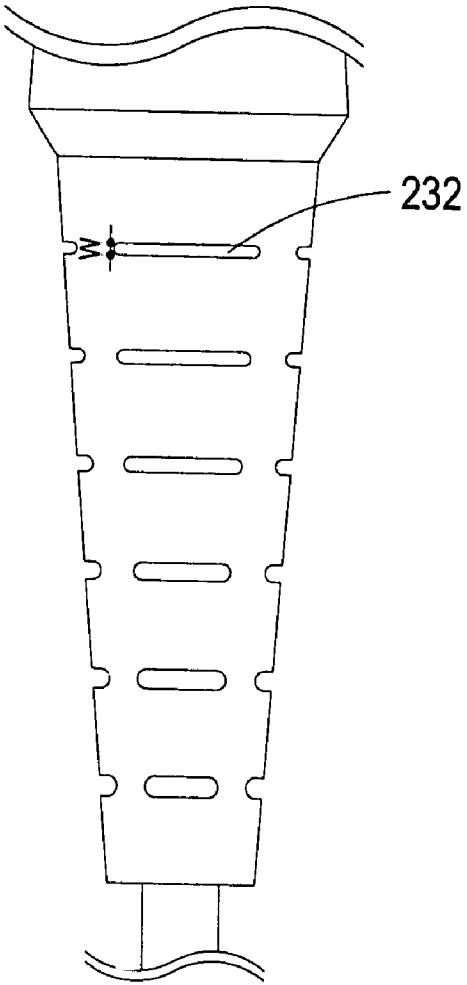

Please refer to FIGS. 5(*a*) and (*b*), which are schematic diagrams showing the buffer structure according to preferred embodiments of the present invention. In these embodiments, the slits 232 of the buffer structure 23 in the same row have different widths (W), wherein the upper slit 232 has a smaller width than the lower slit 232, and the variation of the width can be in regular progress, such as in arithmetic progression or geometric progression, or in irregular progress, as shown in FIG. 5(*a*). Or, the slits 232 can be divided into groups, and the slits 232 in different groups may have different widths, so as to achieve the object that the upper slits have larger widths and the lower slits have smaller widths. For example, in the condition that the buffer structure 23 has six slits 232 in each row, the upper three slits 232 have the width W1 and the lower three slits 232 have width W2, wherein W1<W2, as shown in FIG. 5(*b*).

Figure 6:
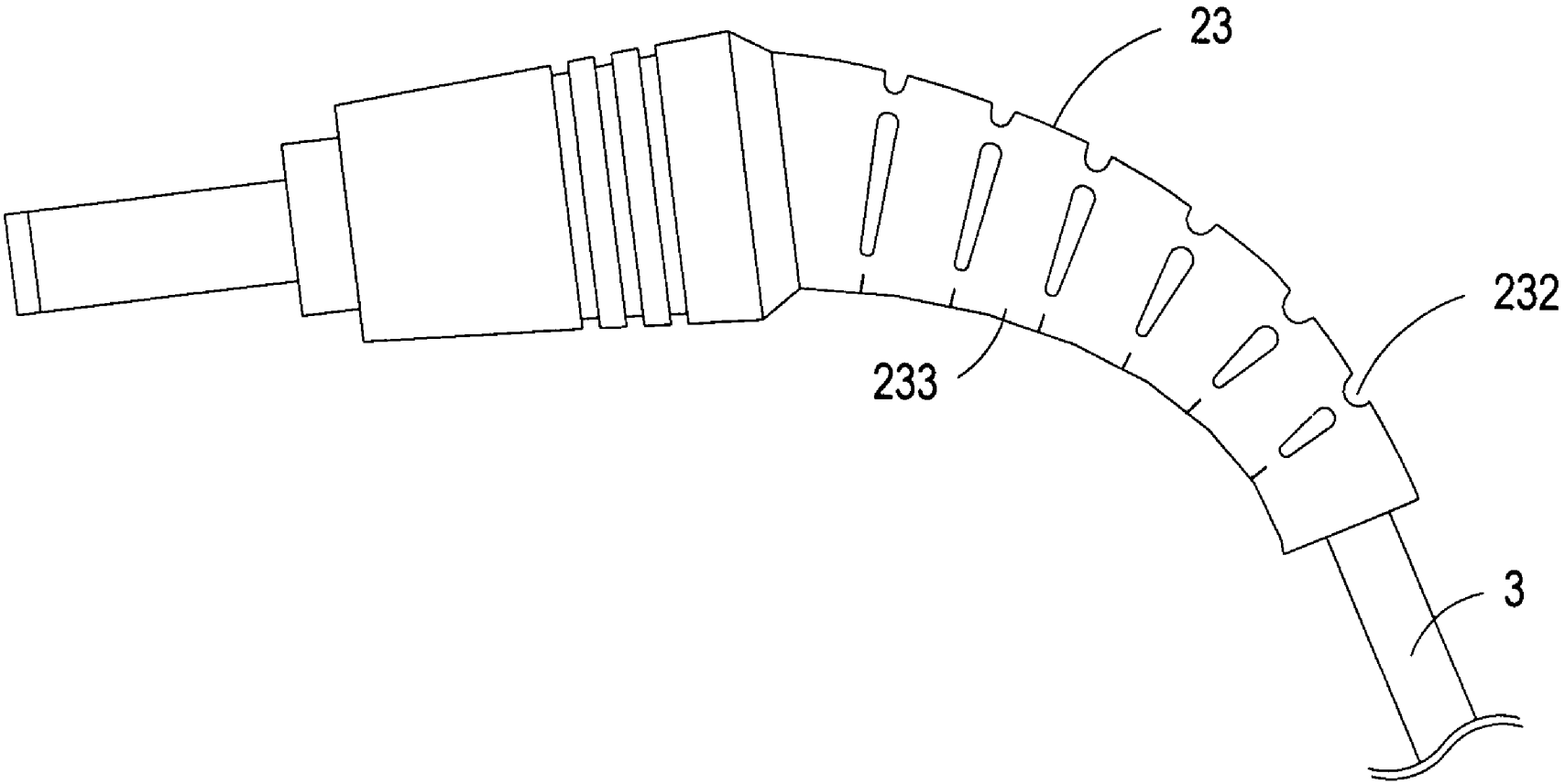
FIG. 6 is a schematic diagram showing the bending structure of the power cord connector according to a preferred embodiment of the present invention.

Please refer to FIG. 6, which is a schematic diagram showing the bending structure of the power cord connector according to a preferred embodiment of the present invention. In the embodiment, when the power cord 3 is bent, the buffer structure 23 is bent simultaneously. On the outer edge of the bending arc, since the bending degree at the lower side of the buffer structure 23 is larger than that at the upper side, the slits 232 located at the lower side of the buffer structure 23 and having larger widths can provide larger deformation quantity to facilitate the bending. On the other hand, the slits 232 located on the inner edge of the bending arc are compressed while bending. Similarly, since the bending degree at the lower side of the buffer structure 23 is larger than that at the upper side and the widths of the slits 232 are gradually increased from the upper side to the lower side, the openings of the slits 232 located on the inner edge of the bending arc are closed while bending and the spacers 233 are against each other, so as to provide support and relieve the bending stress for avoiding the breakage of the buffer structure 23.

Figure 7B:
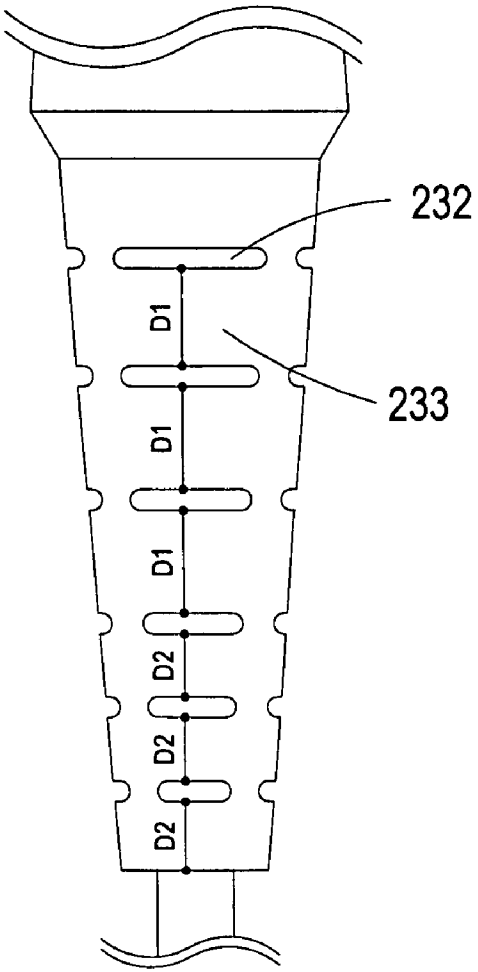
FIGS. 7(*a*) and (*b*) are schematic diagrams showing the buffer structure according to preferred embodiments of the present invention.
Figure 7A:
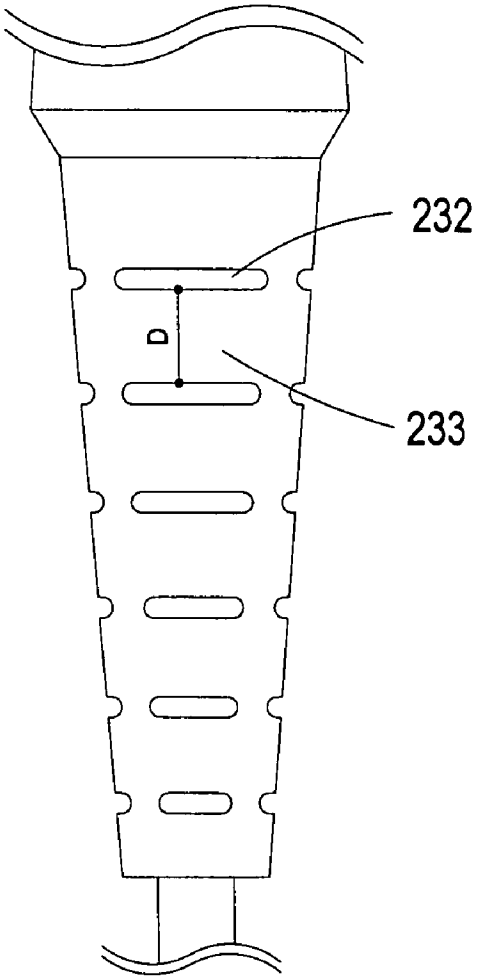

The above effect can be achieved through a different design of the buffer structure. Please refer to FIGS. 7(*a*) and (*b*), which are schematic diagrams showing the buffer structure according to preferred embodiments of the present invention. In these embodiments, the slits 232 of the buffer structure 23 in the same row have the same widths (W), but the spacers 233 located at the upper side of the buffer structure 23 have larger widths (D) than the spacers 233 located at the lower side of the buffer structure 23. The variation of the width (D) of the spacers 233 can be in regular progress, such as in arithmetic progression or geometric progression, or in irregular progress, as shown in FIG. 7(*a*). Or, the spacers 233 can be divided into groups, and the spacers 233 in different groups may have different widths, as shown in FIG. 7(*b*), wherein D1>D2. That is to say, by varying the width (D) of the spacer 233 (gradually decreased from the upper side to the lower side) can also achieve the effect caused by varying the width (W) of the slits 232 (gradually increased from the upper side to the lower side).

In addition, as shown in FIG. 2, the four corners 2321 at the top opening of the slit 232 are not right angles but round angles. When the buffer structure 23 is bent, the slits 232 are deformed and expanded, and thus, if the corners of the slit 232 are right angles, the bending stress will easily focus on the right angles, which become start points of breakage. Therefore, the four corners 2321 of the slit 232 are designed as round angles to avoid the focus of the bending stress. Similarly, the four corners at the bottom of the slit 232 are also designed as round angles. Certainly, the slit 232 can also be designed to have two round angles at the two ends thereof, or be designed as a long ellipse.

In an embodiment, since the buffer structure 23 is a cylinder having a larger diameter at the upper side thereof, the width (S) of the rib 234 at the upper side of the buffer structure 23 is larger than that at the lower side to match up the buffer structure 23.

Figure 8:
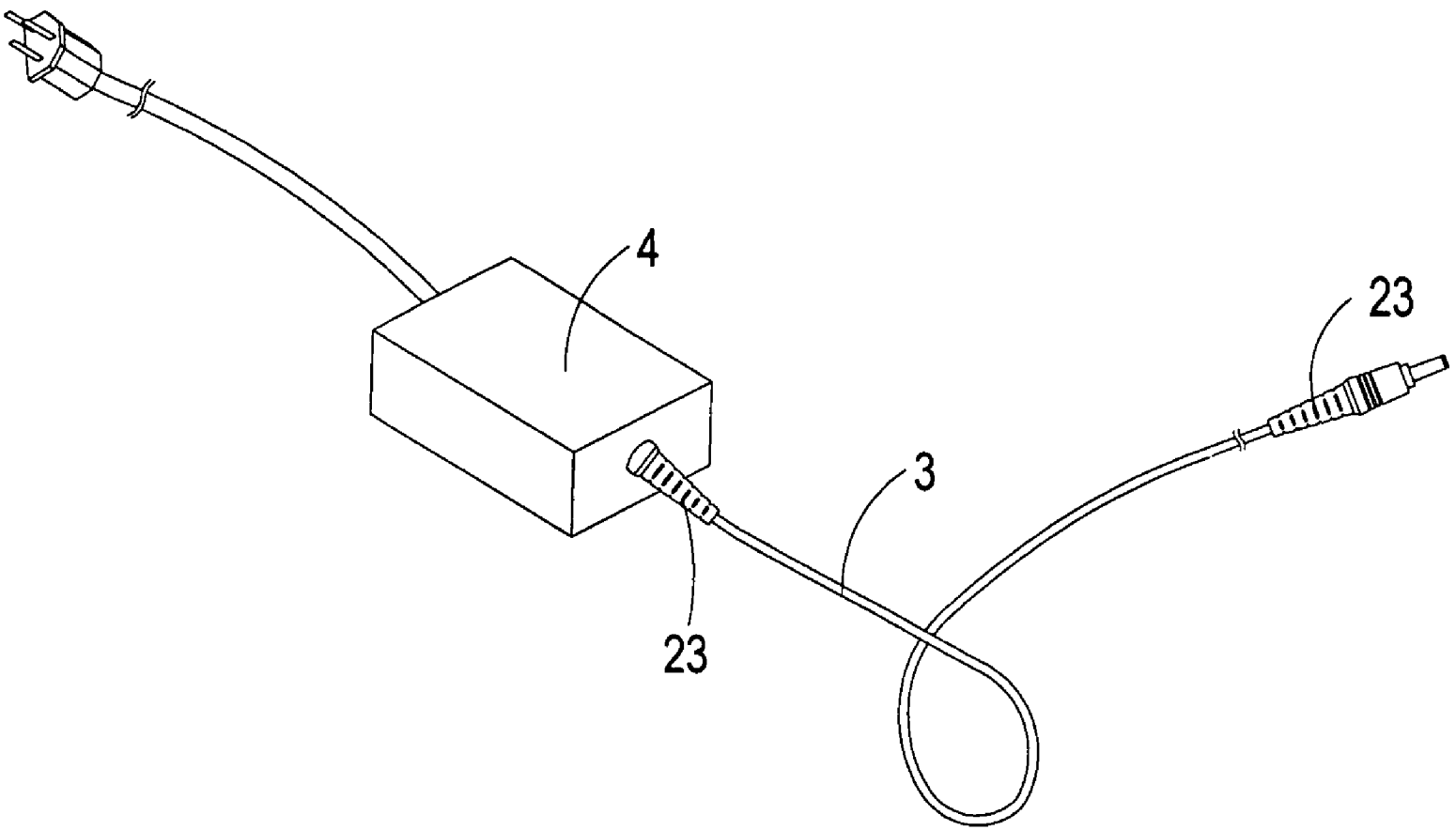
FIG. 8 is a schematic diagram showing the buffer structure applied to the power cord at the end connected to the adapter.
Figure 9:
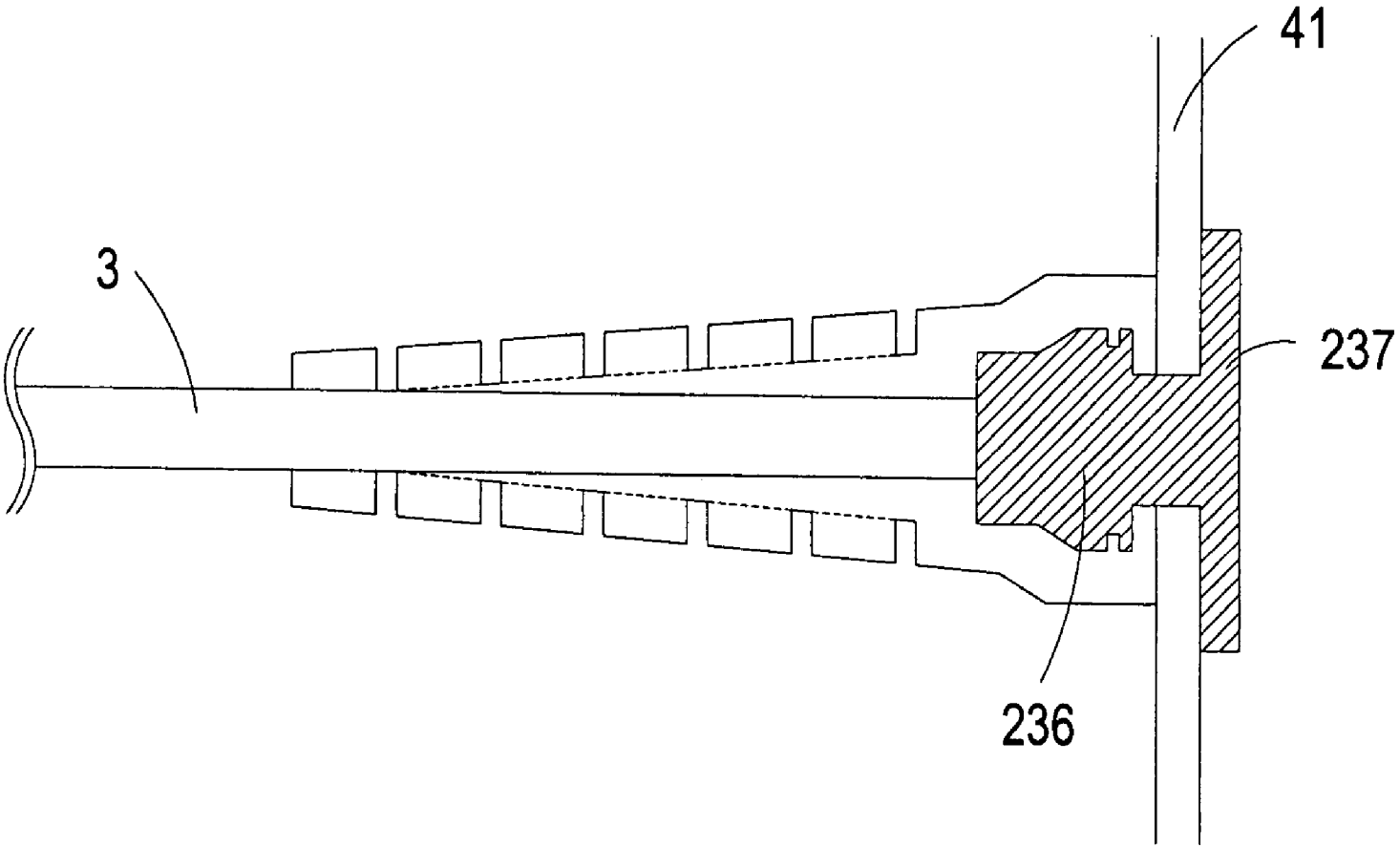
FIG. 9 shows a cross-section view of the buffer structure according to a further preferred embodiment of the present invention.

In the above embodiments, the buffer structure 23 is applied to a power cord connector of a DC power cord of an adapter at the end that connects to an electronic apparatus; however, it is used to illustrate the techniques of the present invention but not limit the present invention. The buffer structure 23 can also be applied to the other end of the power cord 3 that connects to the adapter 4, as shown in FIG. 8. To further enhance the strength of the buffer structure 23 at the connecting end of the power cord 3 and the adapter 4, in an embodiment, the buffer structure 23 can be formed by double moldings. As shown in FIG. 9, an inner mold 236 is formed at first, wherein the inner mold 236 includes a blocking plate 237 for engaging with the casing 41 of the adapter 4, and the other parts of the buffer structure 23 are formed by the second molding. The molding material of the first molding is the same as that of the second molding, but the hardness of the first molding is harder than that of the second molding, so as to enhance the strength of the buffer structure 23 at the connecting end of the power cord 3 and the adapter 4.

In fact, the buffer structure of the present invention can be applied to the connecting end of any power cord, no matter what the form of the connecting terminal is. For example, the buffer structure of the present invention can be applied to the AC plug plugging in a commercial socket, the USB plug, the PS/2 plug, the internet cable plug, or the plug of earphone or microphone.

In conclusion, the present invention provides a buffer structure for a power cord connector, wherein the buffer structure has a plurality of slits, and the top area of the slit is larger than the bottom area of the slit for enhancing the strength of the buffer structure. In addition, the buffer structure further comprises a coating layer disposed at the bottom of the slit, and the thickness of the coating layer is smaller and smaller from the upper side to the lower side of the buffer structure, so that the strength of the buffer structure that is close to the connecting end of the power cord and the connecting terminal has a stronger strength. Moreover, by varying the width of the slits or the spacers, when the buffer structure is bent, the buffer structure that is away from the connecting terminal can provide a larger deformation quantity to facilitate the bending, and the openings of the slits located on the inner edge of the bending arc are closed and the spacers are against each other, so as to provide support and relieve the bending stress for avoiding the breakage of the buffer structure. Therefore, the design of the present invention can increase both the strength and the flexibility of the buffer structure to effectively protect the connection between the power cord and the connecting terminal from breakage due to bending, so as to ensure the power supply to the electronic apparatus. Based on the test result, the buffer structure of the present invention can bear the swings under the load of 2000 g more than 2000 times, which increases the strength of the buffer structure to ten times of the conventional structure. Therefore, the buffer structure for the power cord connector of the present invention owns high industrial value.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A buffer structure for a power cord connector, comprising:

a main body covering on an exterior of a power cord at a connecting end to an electronic apparatus;

a plurality of slits disposed on said main body, wherein a top area is larger than a bottom area of each of said slits;

a plurality of ribs disposed between said slits in the circumference direction of said main body, wherein a width of each of said ribs increased gradually from top to bottom; and a coating layer disposed at bottoms of said slits, wherein a thickness of said coating layer at said slit close to said connecting end is larger than that at said slit away from said connecting end.

2. The buffer structure for a power cord connector according to claim 1 wherein said main body is a cylinder with different diameters at upper and lower sides.

3. The buffer structure for a power cord connector according to claim 2 wherein a cross-section area of said main body close to said connecting end is larger than that of said main body away from said connecting end.

4. The buffer structure for a power cord connector according to claim 1 wherein a width of said slit away from said connecting end is larger than that of said slit close to said connecting end.

5. The buffer structure for a power cord connector according to claim 1 wherein in an axial direction of said power cord, two adjacent slits define a spacer therebetween, and a width of said spacer away from said connecting end is smaller than that of said spacer close to said connecting end.

6. The buffer structure for a power cord connector according to claim 1 wherein corners of each of said slits are round angles.

7. The buffer structure for a power cord connector according to claim 1 further comprising an inner mold disposed in an interior of said main body close to said connecting end and having a larger hardness than other parts of said main body.

8. A buffer structure for a power cord connector, comprising:

a main body covering on an exterior of a power cord at a connecting end to an electronic apparatus;

a plurality of slits disposed on said main body, wherein a width of said slit away from said connecting end is larger than that of said slit close to said connecting end;

a plurality of ribs disposed between said slits in the circumference direction of said main body, wherein a width of each of said ribs increased gradually from top to bottom;

a coating layer disposed at bottoms of said slits, wherein a thickness of said coating layer at said slit close to said connecting end is larger than that at said slit away from said connecting end.

9. The buffer structure for a power cord connector according to claim 8 wherein said main body is a cylinder with different diameters at upper and lower sides.

10. The buffer structure for a power cord connector according to claim 9 wherein a cross-section area of said main body close to said connecting end is larger than that of said main body away from said connecting end.

11. The buffer structure for a power cord connector according to claim 8 wherein a top area is larger than a bottom area of each of said slits.

12. The buffer structure for a power cord connector according to claim 8 wherein corners of each of said slits are round angles.

13. The buffer structure for a power cord connector according to claim 8 further comprising an inner mold disposed in an interior of said main body close to said connecting end and having a larger hardness than other parts of said main body.

14. A buffer structure for a power cord connector, comprising:

a main body covering on an exterior of a power cord at a connecting end to an electronic apparatus;

a plurality of slits disposed on said main body, wherein in an axial direction of said power cord, two adjacent slits define a spacer therebetween, and a width of said spacer away from said connecting end is smaller than that of said spacer close to said connecting end;

a plurality of ribs disposed between said slits in the circumference direction of said main body, wherein a width of each of said ribs increased gradually from top to bottom; and a coating layer disposed at bottoms of said slits, wherein a thickness of said coating layer at said slit close to said connecting end is larger than that at said slit away from said connecting end.

15. The buffer structure for a power cord connector according to claim 14 wherein said main body is a cylinder with different diameters at upper and lower sides.

16. The buffer structure for a power cord connector according to claim 15 wherein a cross-section area of said main body close to said connecting end is larger than that of said main body away from said connecting end.

17. The buffer structure for a power cord connector according to claim 14 wherein a top area is larger than a bottom area of each of said slits.

18. The buffer structure for a power cord connector according to claim 14 wherein corners of each of said slits are round angles.

19. The buffer structure for a power cord connector according to claim 14 further comprising an inner mold disposed in an interior of said main body close to said connecting end and having a larger hardness than other parts of said main body.

* * * * *